US007500672B2

(12) United States Patent
Ho

(10) Patent No.: US 7,500,672 B2
(45) Date of Patent: Mar. 10, 2009

(54) AUTOMATIC SHUFFLING AND DEALING MACHINE

(75) Inventor: Cai-Shiang Ho, Taipei (TW)

(73) Assignee: Taiwan Fulgent Enterprise Co., Ltd., Taipei (TW)

( * ) Notice: Subject to any disclaimer, the term of this patent is extended or adjusted under 35 U.S.C. 154(b) by 259 days.

(21) Appl. No.: 11/706,237

(22) Filed: Feb. 15, 2007

(65) Prior Publication Data

US 2008/0197565 A1 Aug. 21, 2008

(51) Int. Cl.
*A63F 1/12* (2006.01)

(52) U.S. Cl. ..... 273/149 R

(58) Field of Classification Search ..... 273/149 R, 273/149 P

See application file for complete search history.

(56) References Cited

U.S. PATENT DOCUMENTS 5,989,122 A * 11/1999 Roblejo ..... 463/22
6,267,248 B1 * 7/2001 Johnson et al. ..... 209/547
6,659,460 B2 * 12/2003 Blaha et al. ..... 273/149 R
6,676,127 B2 * 1/2004 Johnson et al. ..... 273/149 R
6,726,205 B1 * 4/2004 Purton ..... 273/148 R
6,889,979 B2 * 5/2005 Blaha et al. ..... 273/149 R
7,367,561 B2 * 5/2008 Blaha et al. ..... 273/149 R

* cited by examiner

*Primary Examiner*—William M Pierce
(74) *Attorney, Agent, or Firm*—Bacon & Thomas, PLLC

(57) ABSTRACT

An automatic shuffling and dealing machine has a shuffling wheel and a card-input device mounted adjacent to the shuffling wheel. The card-input device is provided for putting a stack of playing card and inserting cards into slots formed around the shuffling wheel. The shuffling wheel can be controlled by a controller to rotate randomly, and has a discharging rod to discharge at least one card in the slots of the shuffling wheel as the shuffling wheel temporarily stop in undetermined angles, such that the card arrangement may be randomized. Besides, the automatic shuffling and dealing machine further has a card-output device or card-output apparatus to deal the discharged cards one by one. With such an arrangement, the automatic shuffling and dealing machine may provide convenience for card games.

10 Claims, 8 Drawing Sheets

AUTOMATIC SHUFFLING AND DEALING MACHINE

BACKGROUND OF THE INVENTION

1. Field of the Invention

The present invention relates to a shuffling and dealing device, and more particularly to an automatic shuffling and dealing machine that is convenient for card games.

2. Description of Related Art

Card shufflers have been known for a long time, e.g. U.S. Pat. No. 6,889,979 discloses a card shuffler comprises a drivable shuffling storage means, an input apparatus and an output storage means. The shuffling storage means has multiple compartments to receive and hold cards and is associated with the input apparatus for inserting cards into the compartments. The output storage means is separated from the shuffling storage means for the shuffled card. With the drive of the shuffling storage means and the input apparatus and the output storage means being controlled by an electronic control system, the cards discharging from the shuffling wheel will be in a random sequence. Therefore, the cards are completely shuffled.

Accordingly, the input apparatus has a draw-in zone with a height corresponding substantially to the thickness of a card. Such an arrangement guarantees that only one card at a time is conveyed to the shuffling storage means. However, since most modern playing cards are made of plastic, shuffling the playing cards may generate static electricity and make the playing cards stuck together. Additionally, the cards in the card shuffler are conveyed mostly in a straight manner. Consequently, the cards may easily coincide with or block to each other when conveying and eventually cause the card shuffler to breakdown.

Moreover, most components of the conventional card shufflers are driven by pulleys and toothed belts. Because the pulleys and the toothed belts stretch over time, gaps are inevitably formed between the pulleys and the toothed belts or elastic extension of the toothed belt, which cause the movement of the card shuffler to be less precise.

To overcome the shortcomings, the present invention provides an automatic shuffling and dealing machine to obviate or mitigate the aforementioned problems.

SUMMARY OF THE INVENTION

The main objective of the present invention is to provide a automatic shuffling and dealing machine that completely resolve the shortcoming of the conventional card shuffler.

To achieve the objective, the automatic shuffling and dealing machine comprises a card-input device, a shuffling device and an optional card-output device.

The card-input device has a first swiveling board, a guiding board, a first roller assembly and a first sensor. The first swiveling board is mounted slantwise, selectively sways and has a bottom edge and a surface. The front surface of the first swiveling board is attached with a static electricity mitigating sheet for a card stack to place on and mitigates static electricity of each card of the card stack. The guiding board is horizontally mounted securely in the card-input device adjacent the first swiveling board to form an inlet passage. The guiding board has a top surface and a semicircular-cross-sectional groove formed on the top surface corresponding to the bottom edge of the first swiveling board, such that when the card stack is placed on the first swiveling board, the card stack may insert in the groove. Therefore each card of the card stack will be in a position where an angle exists between two adjacent cards. That is, each card on top of one another is slightly staggered in relation to the card on the bottom of itself. In other words, two adjacent cards do not perfectly coincide with each other. Such ensure each card of the card stack to be drawn one by one.

The first roller assembly has multiple roller couples arranged adjacent to each other along the guiding board. Each roller couples has at least two rollers driven by a gear assembly connected with a motor. An attracting roller is arranged aligning to the surface of the first swiveling board. Such when the first swiveling board is activated to sway, the card stack will be pushed toward the attracting roller and the cards may be drawn into and conveyed along the inlet passage by the first roller assembly one by one.

The shuffling device has a stage, a shuffling wheel and a discharging rod. The stage is set stably on a planar surface and is attached with a controller and a primary power assembly. The primary power assembly is controlled by the controller and drives the shuffling wheel to rotate randomly and be temporarily held in an undetermined angle. The shuffling wheel is mounted rotatably on the stage and has multiple card slots formed diametrically around which, each of the card slots is selectively correspond to the inlet passage and stores at least one card being conveyed by the first roller assembly. The discharging rod is mounted pivotally on the stage and is driven by a driving motor to sway and has an arm protruding transversely from the discharging rod and selectively corresponding to one card slot of the shuffling wheel and discharges the card stored in the corresponding slot out.

The card-output device has a second roller assembly and a second swiveling board. The second roller assembly has a drawing roller and multiple roller couples arranged adjacent to each other. The roller couples of the second roller assembly has at least two rollers driven by a gear assembly connected with a motor. The second swiveling board is pivotally mounted slantwise and adjacent to the shuffling wheel for receiving the card discharged from the shuffling wheel and has a surface corresponding to one roller of the second roller assembly.

When a card is received on the second swiveling board, the received card will be in a slanted status that is not straight relative to the card slots, so an another card discharged later may not block to an edge of the received card. Then, The second swivel board can be activated to sway and push the received cards toward the drawing roller of the second roller assembly, such, one of the cards may be drawn into and conveyed by the second roller assembly at a time for dealing.

Obviously, the roller assemblies, the shuffling wheel and the discharging rod are driven via gears or directly by motors, so the automatic shuffling and dealing machine can motivate more precisely.

Moreover, since the first roller assembly or the second roller assembly draws the cards one by one, plus the arrangement of the static electricity mitigating sheet, the cards will not coincide with or block to each other when conveying and effectively prevent the automatic shuffling and dealing machine to breakdown.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1, 2, 6, 7 and 8, the automatic shuffling and dealing machine in accordance with the present invention comprises a card-input device (20), a shuffling device (10) and an optional card-output device (30) or an optional card-output apparatus (40).

Figure 1:
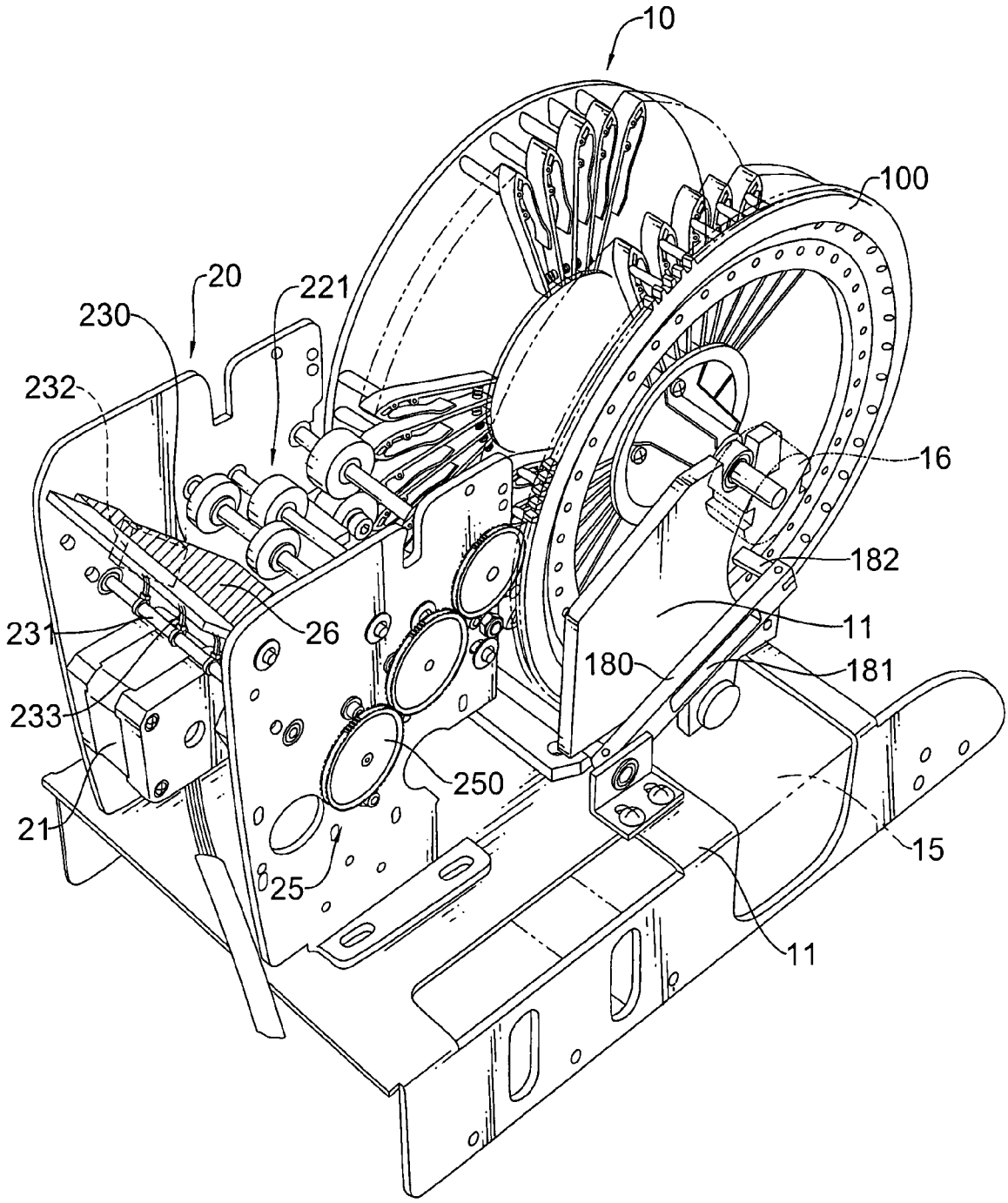
FIG. 1 is a partial perspective view of an automatic shuffling and dealing machine in accordance with the present invention.
Figure 2:
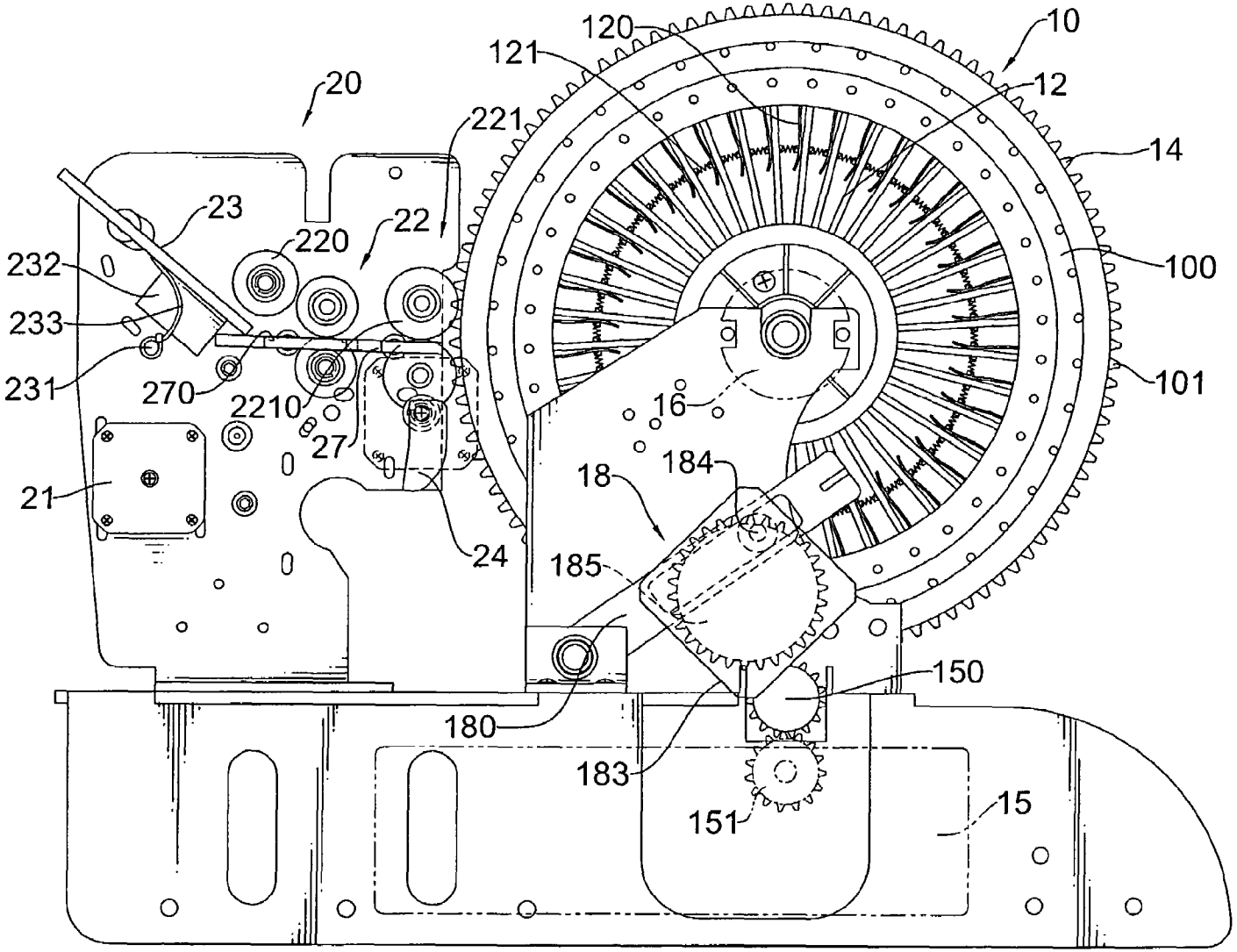
FIG. 2 is partial side view of the automatic shuffling and dealing machine in FIG. 1.
Figure 3:
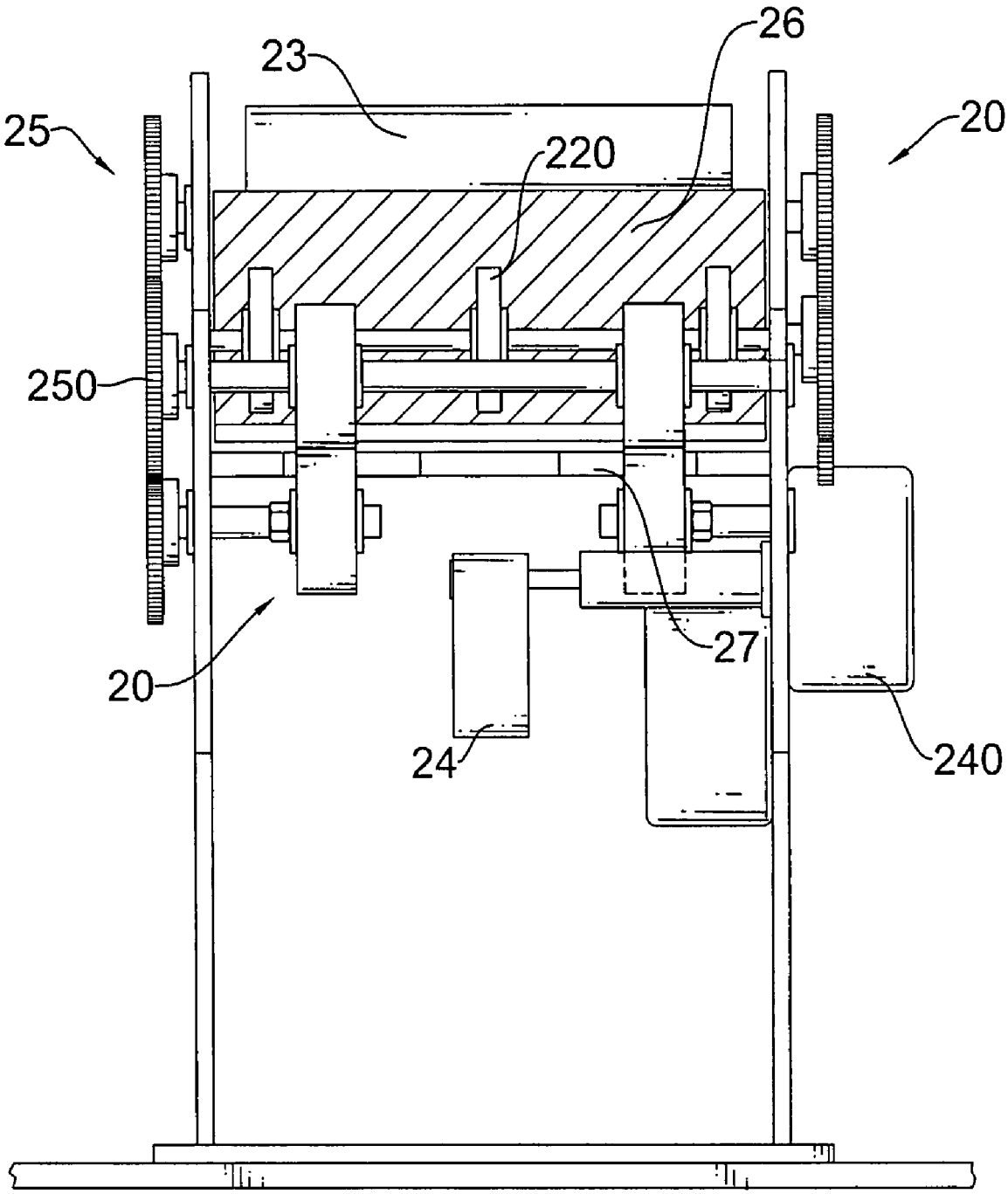
FIG. 3 is a front view of the card-input device of the automatic shuffling and dealing machine in FIG. 1.

With reference to FIGS. 1, 2 and 3, the card-input device (20) has a first motor (21), a first gear assembly (25), a first swiveling board (23), a first swiveling assembly, a guiding board (27), a first roller assembly (22), a lever (24) and a first sensor (232).

The first gear assembly (25) comprises multiple gears (250) engaged to each other, one of the gears (250) is connected with and is driven by the first motor (21).

Figure 5:
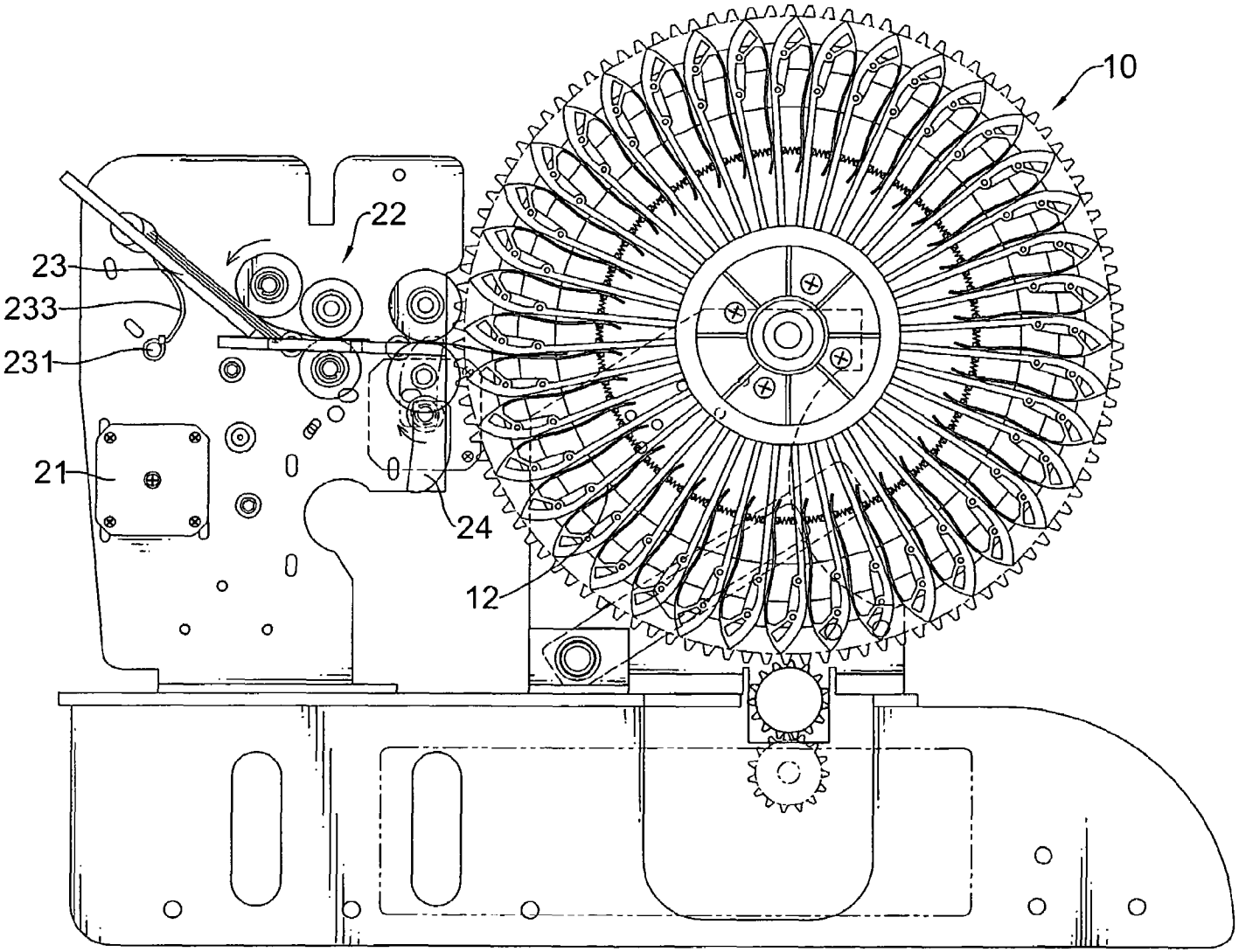
FIG. 5 is a partial side view in partial section of the automatic shuffling and dealing machine in FIG. 1.

With reference to FIGS. 2 and 5, the first swiveling board (23) is pivotally mounted slantwise in the card-input device (20), selectively sways and has two sides, a bottom edge, a back surface, a front surface and a notch (230). The front surface of the first swiveling board (23) is attached with a static electricity mitigating sheet (26) for a card stack to place on and mitigates static electricity of each card of the card stack. The notch (230) is formed in one of the sides of the first swiveling board (23).

The first swiveling assembly has a pintle (231) and multiple pushing elements (233). The pintle (231) is mounted rotatably in the card-input device (20), has an end attached to one of the gears (250) of the first gear assembly (25) and is driven by the first motor (21). The pushing elements (233) are elastic, are mounted transversely on the pintle (231) and correspond to the back surface of the first swiveling board (23) to push the first swiveling board (23) to sway when the pintle (231) is rotating.

The guiding board (27) is horizontally mounted securely in the card-input device (20) adjacent the first swiveling board (23) to form an inlet passage. The guiding board (27) has a top surface, a bottom surface, multiple apertures and a semicircular-cross-sectional groove (270). The apertures are formed through the guiding board (27). The groove (270) is formed in the top surface of the guiding board (27) and corresponds to the bottom edge of the first swiveling board (23). When the card stack is placed on the first swiveling board (23), the card stack may insert in the groove (270). Therefore, each card of the card stack will be in a position where an angle exists between two adjacent cards. Thus, each card on top of one another is slightly staggered in relation to the card on the bottom of itself. In other words, two adjacent cards do not perfectly coincide with each other. Such ensure each card of the card stack is not adhering to an adjacent card and being drawn one by one.

With further reference to FIGS. 2 and 5, the first roller assembly (22) has at least two roller couples (221) and an attracting roller (220). The roller couples (221) are mounted in the card-input device (20) adjacent to each other along the guiding board (27). Each roller couple (221) comprises two rollers (2210) that mounted rotatably in the card-input device (20) opposite to each other. One of the rollers (2210) is passing through at least one corresponding aperture of the guiding board (27) and a slight gap is formed between the rollers (2210) at the same level with the surface of the guiding board (27) that allows a card to pass through. Each roller couple (221) has at least one roller (2210) connected to and rotated by one of the gears (250) of the first gear assembly (25).

The attracting roller (220) of the first roller assembly (22) is mounted rotatably in the card-input device (20) adjacent to the front surface of the first swiveling board (23) and is connected to and is rotated by one of the gears (250) of the first gear assembly (25). Such that the attracting roller (220) is driven by the first motor (21) and draws the cards of the card stack one by one into the inlet passage and translated via rotation of the roller couples (221).

With reference to FIG. 3, the lever (24) is mounted in the card-input device (20) adjacent to the shuffling device (10) and is connected to and is rotated by a control motor (240). The control motor (240) rotates the lever (24) to push a card conveyed toward an end of the inlet passage Therefore, the card is completely pushed into the shuffling device (10).

The first sensor (232) is mounted securely on the back surface of the first swiveling board (23), corresponds to the notch (230) in the first swiveling board (23), detects the existence of the card stack through the notch (230) and actuates the first motor (21) to sway the first swiveling board (23). When the card stack is putting on the front surface of the first swiveling board (23), the card stack will be pushed toward the attracting roller (220) and drawn into and conveyed along the inlet passage one by one by the roller couples (221) of the first roller assembly (22).

The shuffling device (10) has a stage (11), a shuffling wheel (100), two discharging rods (180) and a driving motor (183).

The stage (11) can be placed on a planar surface, has an activating gear (150), a primary power assembly (15) and a controller (16). The activating gear (150) is mounted rotatably on the stage (11). The primary power assembly (15) has a driving gear (151) engaging with the activating gear (150). The controller (16) is mounted securely on the stage (11), controls the primary power assembly (15) to drive the activating gear (150) to rotate randomly or temporarily held in an undetermined angle.

Figure 4:
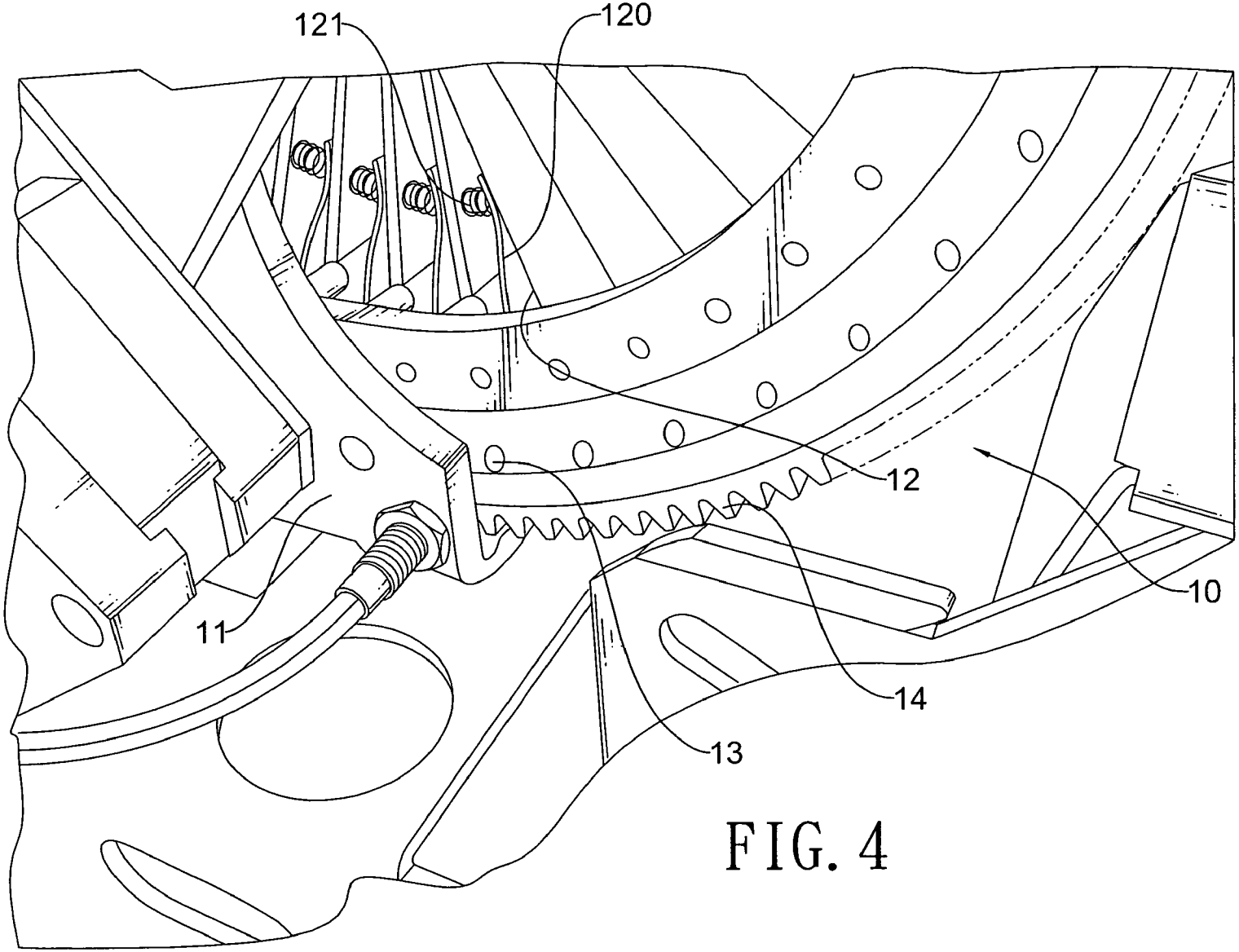
FIG. 4 is an enlarged partial perspective view of the automatic shuffling and dealing machine in FIG. 1.
Figure 6:
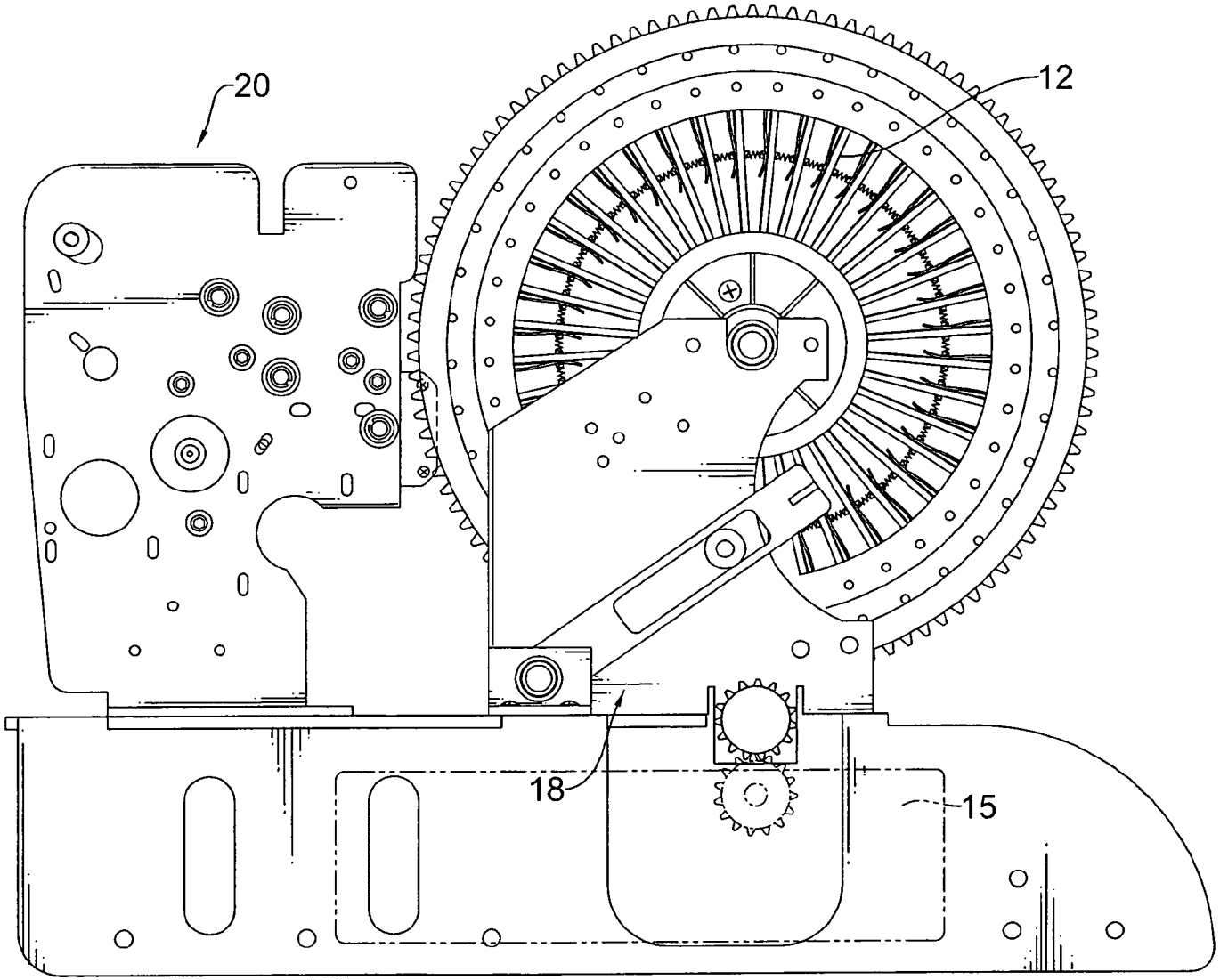
FIG. 6 is an operational side view of the automatic shuffling and dealing machine in FIG. 1.

With further reference to FIGS. 4 and 6, the shuffling wheel (100) is mounted rotatably on the stage (11), is driven by the primary power assembly (15) and has multiple teeth (101), multiple card slots (12), multiple resilient element (121) and multiple retainer (120). The teeth (101) are formed around the shuffling wheel (100) and are engaged with the activating gear (150) of the primary power assembly (15) of the stage (11). Via engagement with the activating gear (150), the shuffling wheel (100) is controlled by the primary power assembly (15) to rotate and be temporarily held in an undetermined angle. The card slots (12) are formed diametrically around the shuffling wheel (100), and each card slot (12) selectively aligns with the inlet passage and stores at least one card pushed by the lever (24) and has an inner surface. The retainer (120) and the resilient element (121) mounted respectively in the card slots (12), the retainer (120) is pushed by the resilient element (121) to abut the inner surface of the card slot to stably hold the at least one card stored in the card slot (12).

With further reference to FIGS. 1 and 2, the discharging rods (180) are mounted pivotally on the stage (11), are mounted oppositely adjacent to the shuffling wheel (100) and has an elongate slot (181) and an arm (182). The elongate slot (181) is formed longitudinally through the discharging rod (180). The arm (182) protrudes transversely from the discharging rod (180) and selectively aligns with one of the card slots (12) to push the card leaving the card slot (12).

The driving motor (183) has a rotating disk (185) and a pin (184) eccentrically mounted securely on the rotating disk (185) and mounted slidably in the elongate slot (181) of the corresponding discharging rod (180).

Figure 7:
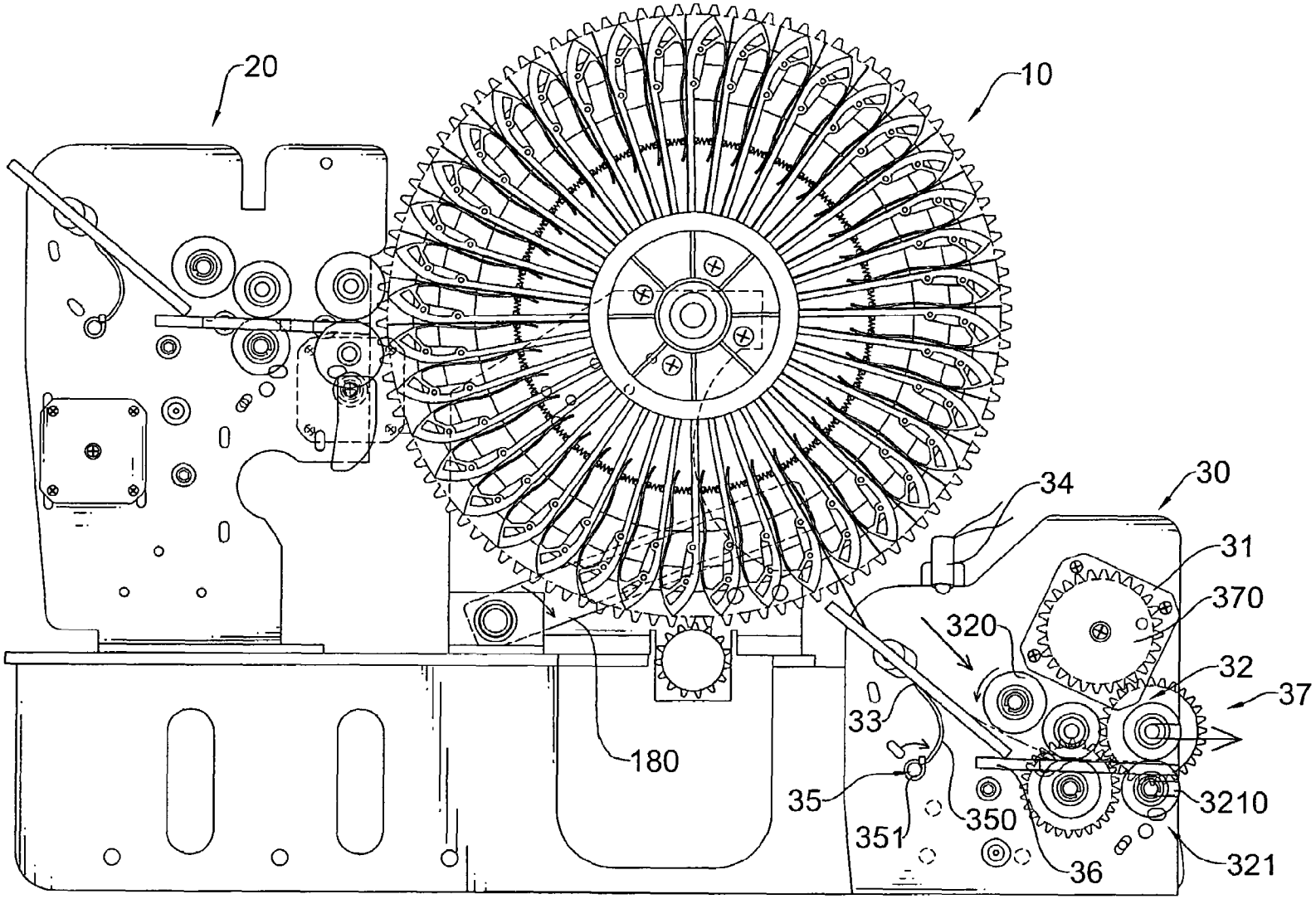
FIG. 7 is an operational side view in partial section of the automatic shuffling and dealing machine in FIG. 1 showing the card dealing by the card-output device.

With further reference to FIG. 7, when the shuffling wheel (100) is held, the rotating disk (185) of the driving motor (183) is rotated, the pin (184) reciprocatingly slides along the elongate slot (181) of the discharging rod (180) to make the discharging rod (180) sway. The arm (182) aligns with one of the card slots (12) of the shuffling wheel (100) and discharges the card stored in the corresponding card slot (12). Since the shuffling wheel (100) is held in undetermined angles, the cards discharged from the shuffling wheel (100) will be in a random sequence, therefore complete the shuffle of the cards.

With reference to FIG. 7, the card-output device (30) is mounted beside the shuffling device (10) opposite to the card-input device (20) and has a second motor (31), a second gear assembly (37), a second swiveling board (33), a second swiveling assembly (35), a dealing board (36), a second roller assembly (32) and a second sensor (34).

The second gear assembly (37) comprises multiple gears (370) engaged to each other, one of the gears (370) is connected with and is driven by the second motor (31).

The second swiveling board (33) is mounted pivotally slantwise in the card-output device (30) adjacent to the shuffling wheel (100), selectively sways and has a bottom edge, a front surface and a back surface.

The second swiveling assembly (35) has a pintle (351) and multiple pushing elements (350). The pintle (351) is mounted rotatably in the card-output device (30) and has an end attached to one of the gears (370) of the second gear assembly (37) to be driven by the second motor (31). The pushing elements (350) are elastic, are mounted transversely on the pintle (351) and correspond to the back surface of the second swiveling board (33) to push the second swiveling board (33) to sway when the pintle (351) is rotating.

The dealing board (36) is horizontally mounted securely in the card-output device (30) adjacent to the second swiveling board (33) to form an outlet passage. The dealing board (36) has a top surface, a bottom surface multiple apertures and a semicircular-cross-sectional groove (360). The apertures are formed through the dealing board (36). The groove (360) is formed in the top surface of the dealing board (36) and corresponds to the bottom edge of the second swiveling board (33). When at least two cards are discharged from the card slots (12) to be placed on the second swiveling board (33), the cards may insert in the groove (360). Therefore, the cards will be in a position where an angle exists between two adjacent cards. Thus, each card on top of one another is slightly staggered in relation to the card on the bottom of itself. In other words, two adjacent cards do not perfectly coincide with each other. Such ensure discharged cards are not adhering to each other and being drawn one by one.

The second roller assembly (32) has at least two roller couples (321) and a drawing rollers (320). The roller couples (321) are mounted in the card-output device (30) along the dealing board (36) and are adjacent to each other. Each roller couple (321) comprises two rollers (3210). One of the rollers (3210) is passing through at least one corresponding aperture of the dealing board (36) and a slight gap is formed between the rollers (3210) at the same level with the dealing board (36) that allows a card to pass through. Each roller couple (321) has at least one roller (3210) connected to and rotated by one of the gears (370) of the second gear assembly (37).

The drawing roller (320) of the second roller assembly (32) is mounted rotatably in the card-output device (30) adjacent to the front surface of the second swiveling board (33) and is connected to and is rotated by one of the gears (370) of the first gear assembly (37). Such that the drawing roller (320) is driven by the second motor (31) and draws the cards placed on the second swiveling board (33) one by one into the outlet passage and translated via rotation of the rollers (3210) of the roller couples (321).

The second sensor (34) is mounted securely in the card-output device (30) aligning to the front surface of the second swiveling board (33), detects the existence of the cards and actuates the second motor (31) to sway the second swiveling board (33). When a card is discharged from the shuffling wheel and is placed on the front surface of the second swiveling board (33), the card will be pushed toward the corresponding drawing roller (320) and drawn into and conveyed along the outlet passage by the roller couples (321) of the second roller assembly (32) one by one for dealing.

Figure 8:
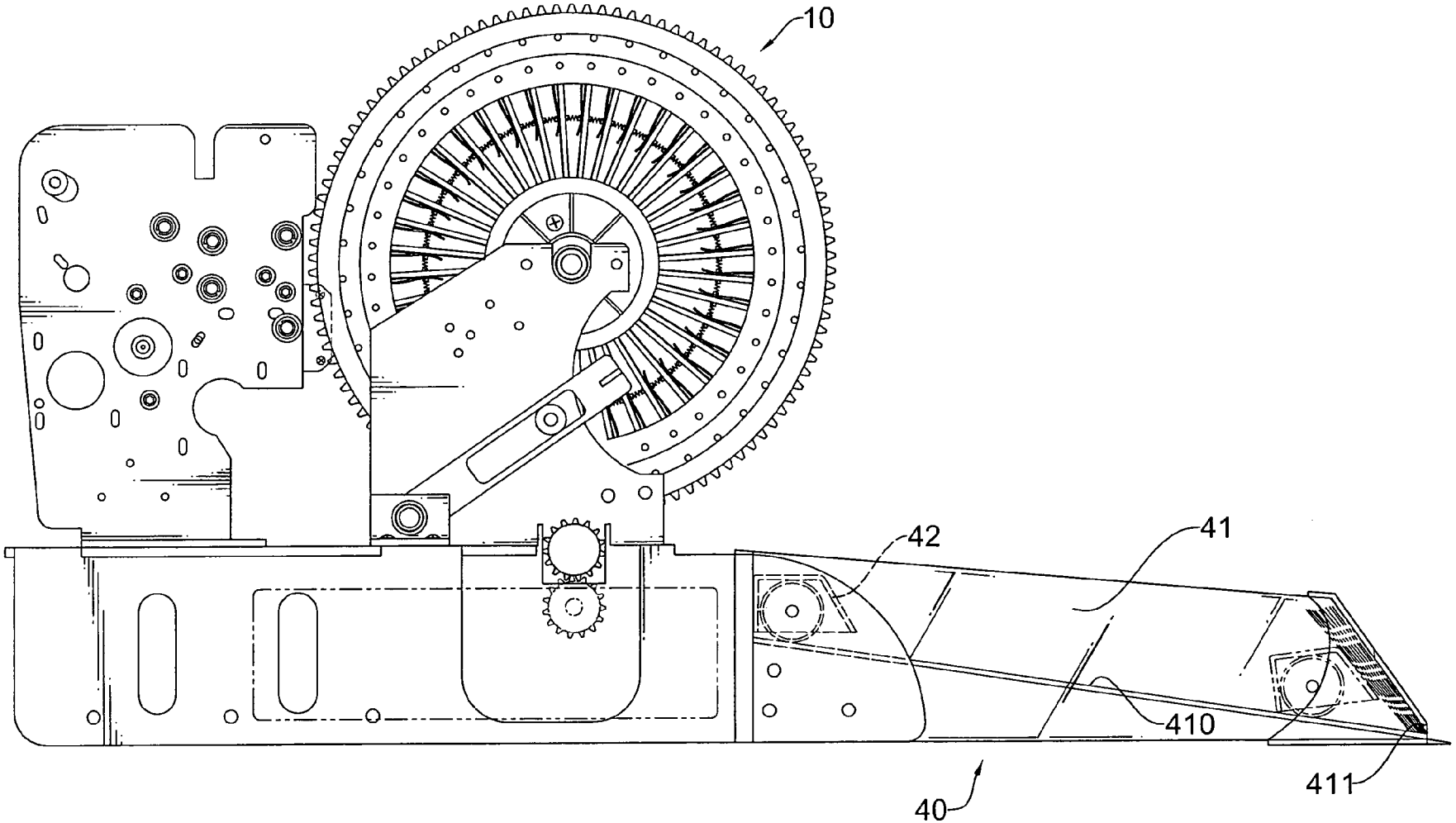
FIG. 8 is an operational side view of another embodiment of the automatic shuffling and dealing machine in accordance with the present invention.

With further reference to FIG. 8, the card-output apparatus (40) has a receiving slot (41) and a wedge (42). The receiving slot (41) is formed inclinedly in the card-output apparatus (40) and has a proximal end, a distal end and a sloping surface (410). The proximal end of the receiving slot (41) is adjacent to the shuffling wheel (110) for receiving the cards discharged from the card slots (12). The distal end has a draw-in gap (411). The draw-in gap (411) is formed through the distal end and corresponds to a thickness of a card to guarantee that only one card at a time is dealt. The wedge (42) is movably arranged on the sloping surface (410), selectively moves along the sloping surface (410) toward the distal end of the receiving slot (41) to press the cards and make the cards sequentially protruding out from the draw-in gap (411).

Obviously, the roller assemblies (22)(32) and the discharging rods (180) are directly driven via gears assemblies (25)(37), the shuffling wheel (100) is driven directly by the activating gear (150) and the primary power assembly (15), so that the automatic shuffling and dealing machine is motivated more precisely.

Moreover, since the first roller assembly (22) or the second roller assembly (32) effectively draws the cards one by one, plus the arrangement of the static electricity mitigating sheet (26) to mitigate static electricity of each card of the card stack, the cards, the cards will not be coincide with or block to each other when conveying. Such that breakdown due to cards jam in the automatic shuffling and dealing machine can be effectively prevented.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. An automatic shuffling and dealing machine comprising a card-input device having a first motor;

a first gear assembly comprising multiple gears engaged to each other, and one of the gears being connected with and driven by the first motor;

a first swiveling board being pivotally mounted slantwise in the card-input device and having a bottom edge;

two sides;

a back surface;

a front surface being attached with a static electricity mitigating sheet; and a notch being formed through the surface in one of the sides of the first swiveling board;

a guiding board being horizontally mounted securely in the card-input device adjacent the first swiveling board to form an inlet passage and having a surface; and a semicircular-cross-sectional groove formed on the surface corresponding to the bottom edge of the first swiveling board;

a first roller assembly having at least two roller couples being mounted in the card-input device adjacent to each other along the guiding board, and each roller couple comprising two rollers separately mounted rotatably in the card-input device opposite to each other and having a slight gap formed between each other and at the same level with the surface of the guiding board, and each roller couple having at least one roller connected to one gear of the first gear assembly; and an attracting roller being mounted rotatably in the card-input device aligning to the front surface of the first swiveling board and having at least one end connected to one of the gears of the first gear assembly;

a lever being mounted in the card-input device and being connected to and is rotated by a control motor; and a shuffling device having a stage having an activating gear being mounted rotatably on the stage;

a primary power assembly having a driving gear engaging with the activating gear; and a controller being mounted securely on the stage, controlling the primary power assembly;

a shuffling wheel being mounted rotatably on the stage, driven by the primary power assembly and having multiple teeth being formed around the shuffling wheel and being engaged with the activating gear of the stage; and multiple card slots being formed diametrically around the shuffling wheel and selectively corresponding to the inlet passage and;

a discharging rod being mounted pivotally on the stage and mounted oppositely adjacent to the shuffling wheel and having an elongate slot being formed longitudinally through the discharging rod; and an arm protruding transversely from the discharging rod and selectively aligning with one of the card slots;

a driving motor having a rotating disk; and a pin eccentrically mounted securely on the rotating disk and mounted slidably in the elongate slot of a corresponding discharging rod.

2. The automatic shuffling and dealing machine as claimed in claim 1, further comprises a card-output device having a second motor;

a second gear assembly comprising multiple gears engaged to each other, one of the gears being connected with and driven by the second motor;

a second swiveling board being pivotally mounted slantwise in the card-output device adjacent to the shuffling wheel and having a bottom edge;

a front surface; and a back surface;

a dealing board being horizontally mounted securely in the card-output device adjacent the second swiveling board to form an outlet passage and having a surface; and a semicircular-cross-sectional groove formed on the surface corresponding to the bottom edge of the second swiveling board;

a second roller assembly having at least two roller couples being mounted in the card-output device adjacent to each other along the dealing board, and each roller couple comprising two rollers separately mounted rotatably in the card-output device opposite to each other and having a slight gap formed between each other and at the same level with the surface of the dealing board, and each roller couple having at least one roller connected to one of the gears of the second gear assembly; and a drawing rollers being mounted rotatably in the card-output device aligning to the front surface of the second swiveling board and having at least one end connected to one of the gears of the first gear assembly.

3. The automatic shuffling and dealing machine as claimed in claim 1, wherein the card-input device further has a first swiveling assembly having a pintle being mounted rotatably in the card-input device and having an end attached to one of the gears of the first gear assembly; and multiple pushing elements being elastic, being mounted transversely on the pintle and corresponding to the back surface of the first swiveling board.

4. The automatic shuffling and dealing machine as claimed in claim 2, wherein the card-output device further has a second swiveling assembly having a pintle being mounted rotatably in the card-output device and having an end attached to one of the gears of the second gear assembly; and multiple pushing elements being elastic, being mounted transversely on the pintle and corresponding to the back surface of the second swiveling board.

5. The automatic shuffling and dealing machine as claimed in claim 2, further comprises a card-output apparatus having a receiving slot being formed inclinedly in the card-output apparatus and having a proximal end being adjacent to the shuffling wheel;

a distal end having a draw-in gap formed through the distal end; and a sloping surface; and a wedge being movably arranged on the sloping surface.

6. The automatic shuffling and dealing machine as claimed in claim 2, wherein card-input device further has a first sensor being mounted securely on the back surface of the first swiveling board aligning to the notch.

7. The automatic shuffling and dealing machine as claimed in claim 2, wherein card-output device further has a second sensor being mounted securely in the card-output device aligning to the front surface of the second swiveling board.

8. The automatic shuffling and dealing machine as claimed in claim 2, wherein each card slot having an inner surface; and the shuffling wheel further has multiple resilient elements being mounted respectively in the card slots; and multiple retainers mounted being mounted respectively in the card slots and being pushed respectively by the resilient elements to abut the inner surfaces of the card slots.

9. The automatic shuffling and dealing machine as claimed in claim 1, wherein the guiding board further has multiple apertures formed through the guiding board; and one of the rollers of each roller couple of the first roller assembly is passing through at least one corresponding aperture of the guiding board.

10. The automatic shuffling and dealing machine as claimed in claim 2, wherein the dealing board further has multiple apertures formed through the dealing board; and one of the rollers of each roller couple of the second roller assembly is passing through at least one corresponding aperture of the dealing board.

* * * * *